United States Patent [19]

Masini et al.

[11] 4,261,079

[45] Apr. 14, 1981

[54] DEVICE FOR RAISING THE BOTTOM OF A CONTAINER

[75] Inventors: Giancarlo Masini, Galliate; Enrico Calcaterra, Cameri, both of Italy

[73] Assignee: Tematex S.p.A., Vergiate, Italy

[21] Appl. No.: 957,165

[22] Filed: Nov. 2, 1978

[30] Foreign Application Priority Data

Nov. 7, 1977 [IT] Italy ..... 83512 A/77
Apr. 14, 1978 [IT] Italy ..... 83367 A/78

[51] Int. Cl.[3] ..... B67C 11/00

[52] U.S. Cl. ..... 19/159 R; 141/270; 187/18; 220/93

[58] Field of Search ..... 414/417, 416, 422, 403; 187/18-20; 220/5 R, 435, 93; 191/66, 67; 141/250, 283, 270, 275; 248/131

[56] References Cited

U.S. PATENT DOCUMENTS

| | | | |
|---|---|---|---|
| 2,284,531 | 5/1942 | Miller | 187/18 X |
| 2,643,662 | 6/1953 | Bunce | 187/20 X |
| 2,798,640 | 7/1957 | Coddington | 187/18 |
| 3,174,722 | 3/1965 | Alm | 187/18 X |
| 3,215,182 | 11/1965 | Silverman | 414/416 X |
| 3,472,488 | 10/1969 | Naughton | 187/18 X |
| 4,026,335 | 5/1977 | Willemsen | 141/250 X |

FOREIGN PATENT DOCUMENTS

| | | | |
|---|---|---|---|
| 1473991 | 3/1967 | France | 187/18 |

*Primary Examiner*—Stephen G. Kunin
*Assistant Examiner*—Terrance L. Siemens
*Attorney, Agent, or Firm*—Blanchard, Flynn, Thiel, Boutell & Tanis

[57] ABSTRACT

A device for raising the bottom of a can, wherein a lift plate slides vertically inside the can and is activated by a pantograph extending axially thereof. A base structure transmits vertical drive from a vertically-extendable fluid drive to the lower end of the pantograph, which pantograph at its upper end is connected to the plate. The plate is independent of the bottom of the can.

6 Claims, 5 Drawing Figures

DEVICE FOR RAISING THE BOTTOM OF A CONTAINER

FIELD OF THE INVENTION

This invention relates to an improved device for raising and lowering the bottom of a container.

BACKGROUND OF THE INVENTION

Containers whose bottoms are vertically movable by the devices dealt with in this invention are collecting cans positioned downstream from machines carrying out combing and making preparations for spinning, etc. The continuous improvement of machines used in the conversion cycles or processes for combing, preparing for spinning and so on has raised output to very high levels. As an outcome of the considerable increase in output, the containers for collecting the slivers delivered by the machines have reached bigger and bigger sizes; at the present time the containers (cans) receiving the delivery have a diameter of one meter or more and a height of up to 1.2 to 1.5 meters so as to reduce the number of times the can has to be changed.

To avoid continuous work on the part of the machine operator in replacing full cans with empty ones, the machines have also been equipped with delivery means having devices that change the cans automatically. Even if the operation of changing the can is done by hand, it always takes place with the machine stopped, and therefore automatic changing leads to a considerable reduction in the time during which the machine is stopped and to a corresponding increase in the output of the machine.

In the various conversion processes such as combing, etc., although the machines are not alike, there are always more than one of them and each machine is usually fed with slivers produced by the preceding machine, these slivers being stored temporarily in cans. At the present time the replacement of cans on the creel of the machines is still done by hand. Thus arises the need to maximize the filling of the cans so as to reduce the operations required and thereby to enable each operator to take charge of more machines.

Accordingly, the problem to be solved continues to be the best way to fill the cans so as to efficiently utilize the capacity thereof, since their capacity is limited by their size.

The efficient system of depositing the slivers in the cans by means of rotation was perfected for this very purpose. This system usually provides at the delivery side of the machine a former head (swivelling feeder) which rotates and deposits the slivers in a can which itself rotates slowly and whose diameter is greater than the diameter of the circle formed by the slivers being delivered by the swelling feeder. The regularity of this depositing leads to correct filling of the can provided that the distance between the former head and the collecting bottom of the can remains constant within certain limits.

As said earlier, certain cans at the present time reach a height of 1.2 meters or more and it is therefore natural that the arrangement of the slivers is not properly controlled at the start of filling since there is a considerable distance between the former head and the storage surface at the bottom of the can. During filling, the coils or cycloids of slivers created by the rotation of the former head in coordination with the slow rotating movement of the can are disturbed during the course of the descent of the slivers, and deposition of the slivers on the bottom of the can takes place pell-mell in an irregular manner to the detriment of the filling. Regular formation of the cycloids only takes place when the can has been almost wholly filled pell-mell, and the slivers have reached a height such that they form an upper collecting surface which is very close to or is in contact with the former head.

Besides the above shortcoming, it should be borne in mind that, having machines with a very high delivery speed, it can happen that with material of a short length or fine slivers or slivers with a low consistency, the material itself will be torn away owing to the beating it undergoes during its journey from above to the bottom of the can.

The best filling conditions are obtained only when the surface supporting the material is at all times very close to or almost in contact with the swivelling feeder. For filling to be ideal, the material should also be slightly compressed.

In the processing of cotton, cans of small size are used with a maximum diameter of 600mm. and with a movable bottom which is pushed upwards by a spiral spring so as to prevent the tearing of slivers having a small section, low consistency and a high deformation speed, whereas in the processing of wool, cans of a bigger size and with a fixed bottom are employed.

Devices have been designed which enable the bottoms of the cans to be raised so as to keep the surface supporting the material that arrives from the swivelling feeder to be very close to the swivelling feeder itself at all times. In the present state of knowledge of the art, these devices are substantially two in number.

The first of these devices uses a plurality of pantograph elements activated by a mechanical element (a screw). The other device envisages a rod activated by an endless chain.

These two devices involve many shortcomings. The first device has an excessive height when the device is close up and moreover it does not permit fast lowering in case of an emergency. Besides the defects of the first device, the second device is also unsuitable for receiving rotation and transmitting it to the collecting bottom or plate.

These shortcomings entail many disadvantages. The first disadvantage lies in the fact that excessively tall devices of this type cause their users to provide holes to contain them, but such holes are not always feasible, particularly where the machines are not mounted on raised surfaces, and such holes may necessitate objects hanging from the ceiling.

Another disadvantage of these devices is that, in case of an emergency, the device itself cannot be made to withdraw quickly because of the mechanical means employed.

A third disadvantage arises from the fact that to ensure a homogeneous product, both the can and the bottom should rotate in a coordinated manner and, as this is not possible, one of the main features required by the storage system is thereby lost.

In the final analysis, all these shortcomings and disadvantages lead to a reduction in the output of machines linked to such known devices.

To obviate these deficiencies, which have substantially blocked and limited the use of such devices to specific duties, Applicants have designed and realized some improvements to such cans which have taken shape as improvements to devices that raise the bottoms of the cans, whereby there is a plate which slides vertically within the can and which is activated by an axially-extending pantograph, the improvements including fluid-type means which activate the pantograph vertically, a rotating plate which transfers the vertical drive from the fluid-type means to the pantograph means, and rotating means that support the pantograph, wherein the plate sliding within the can is independent of the bottom of the can itself.

These improvements are aimed at numerous objectives and advantages. One objective is for the storage plate to be able to be raised as desired and to withstand the material being stored with a pressure that can be preset to a desired value.

Yet another objective is that the bottom and the can should rotate at the same time in a coordinated manner.

A further objective is to employ the device with cans now in use without having to refit anew with non-standard cans.

One more objective is to realize a compact device with small overall dimensions which will need a substantially small accommodation area.

Yet another objective is to adopt pneumatic means which, by employing rapid exhaust valves, make it possible to ensure that, when the device changing the can rotates, the device which is our subject is below the paved floor line.

A further objective is to ensure that, if foreign or excess material should enter the can, the device itself will be able to put right the anomalies on its own independently; this, for instance, is not possible with mechanical devices inasmuch as their rigidity does not permit it.

Another advantage is the ability to have a drive with overpressure, the drive being provided with a valve that tends to keep the thrust of the plate against the material being stored almost constant; this is so because the position of the plate itself, and the thrust which it exerts against the material being stored, are strictly correlated and coordinated with the quantity of material entering.

It is an advantage not to have other mechanical devices to transmit and deliver motion, but to have only means to transmit pneumatic or hydraulic impulses.

A further objective is to be able to use indifferently a pneumatic or hydraulic drive, although a pneumatic drive is more advantageous.

To obviate difficulties which lead to an anomalous distribution of forces and thereby to a movement of the inner plate which is neither linear nor gradual nor desirable, the inventors have also provided a variation wherein the fluid-type raising means is fixed to the swivelling casing and this prevents a raising or lowering movement from obstructing the rotary movement. By eliminating any anomalous stresses, this variation enables a linear ascending or descending movement of the plate to be accomplished, such a movement being in conformity with the working requirements.

The invention, therefore, also consists of improvements to devices that raise the bottoms of cans whereby a plate slides vertically within the can by means of a pantograph that extends axially, said improvements including fluid-type means that activate the pantograph vertically and rotating means that support the pantograph, whereby the plate sliding within the can is advantageously independent of the bottom of the can itself and the fluid-type means that activate the pantograph vertically are advantageously solidly fixed to and supported by the rotating means that support the pantograph, and whereby there is also advantageously present a rotating joint means which delivers fluid under pressure.

DETAILED DESCRIPTION

Figure 1:
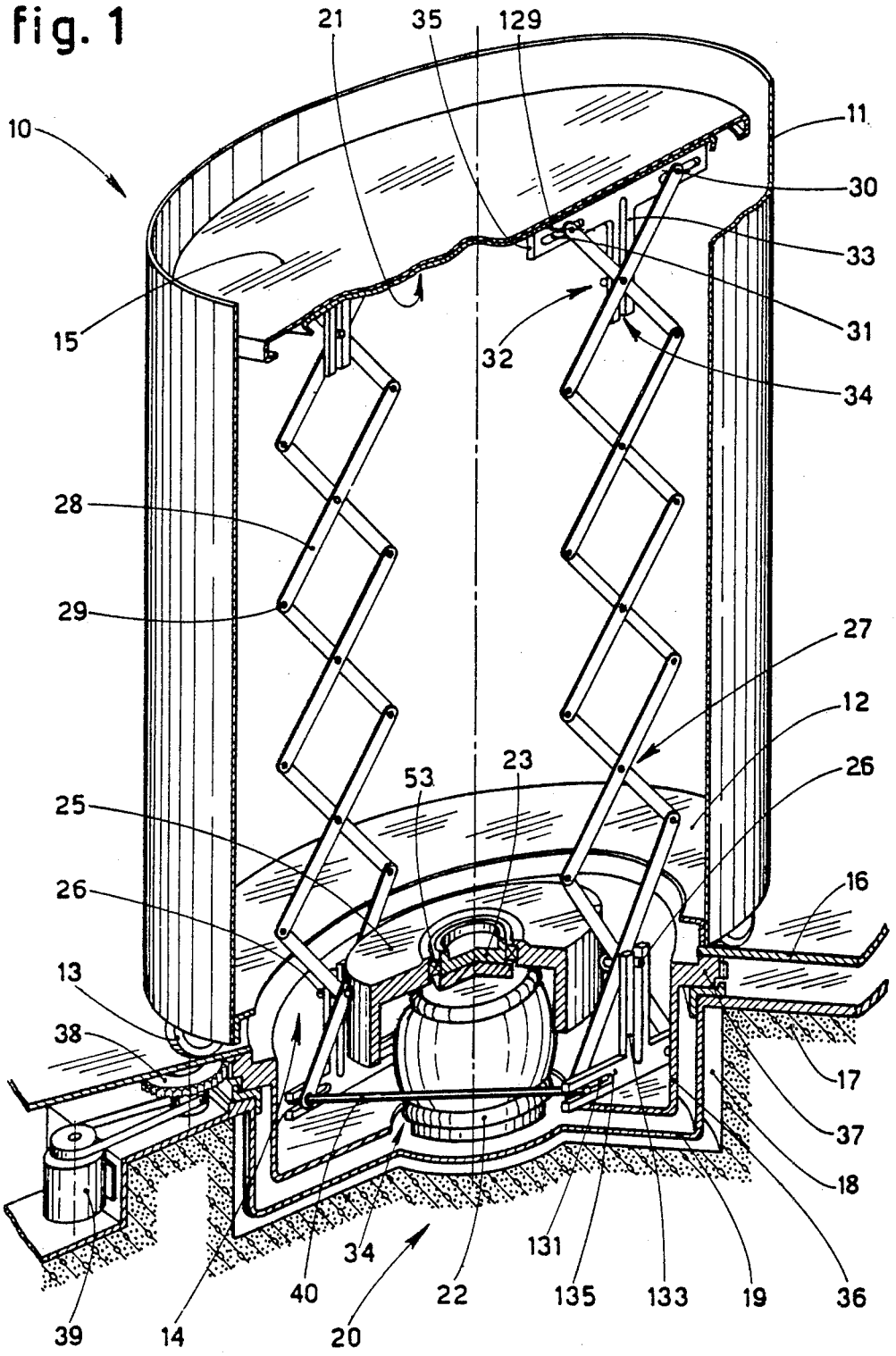
FIG. 1 is a cut-away three-quarters view of a device according to the invention.
Figures 2, 3:
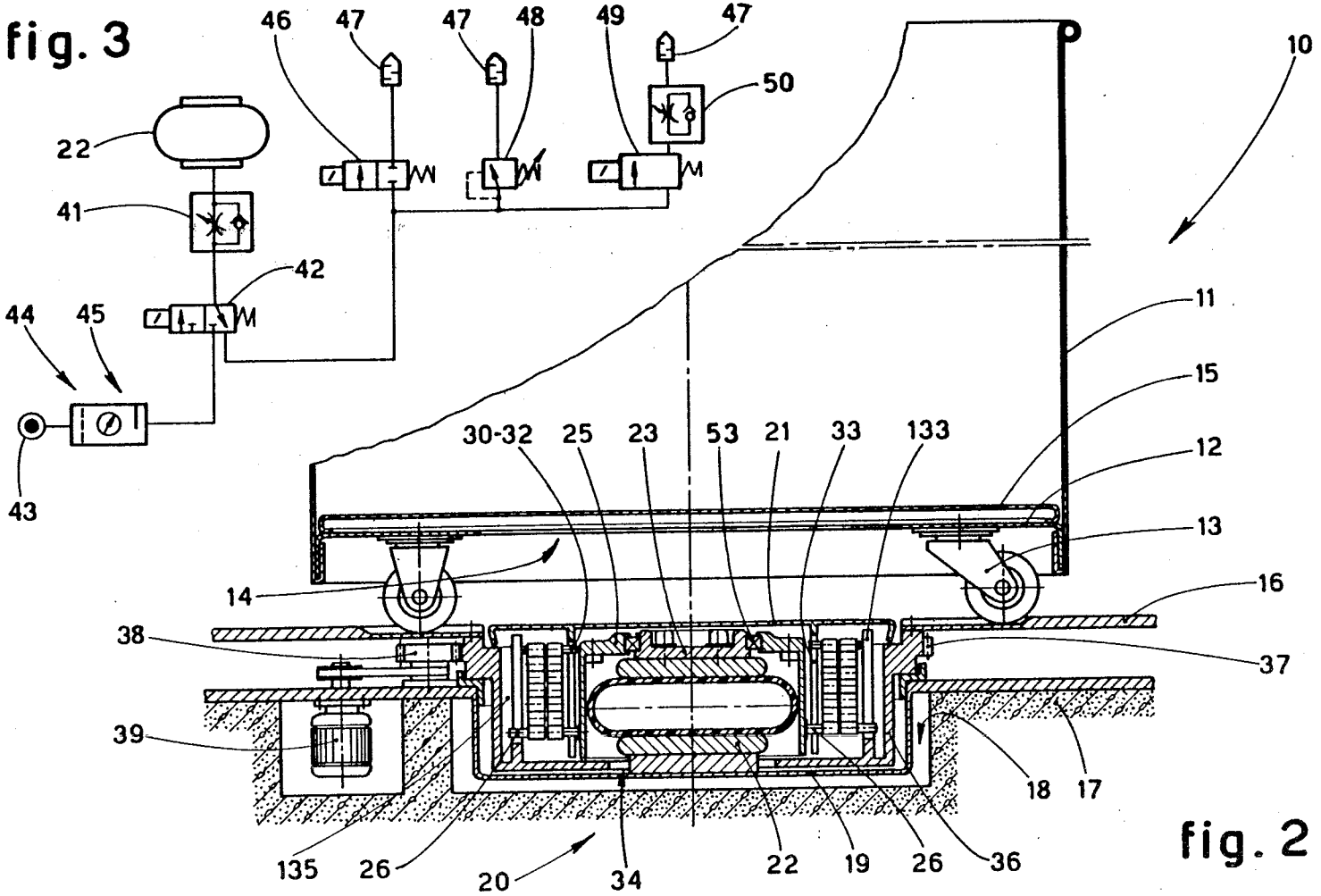
FIG. 2 is a vertical section of the device of FIG. 1.
FIG. 3 diagrams an example of a drive lay-out.

With reference to FIGS. 1–3 we have the following: The can 10 consists of a substantially cylindrical sidewall 11, a fixed bottom 12 and support wheels 13, the bottom 12 being perforated with a large central hole 14. The inside of the can contains a collecting plate 15 which is free to move vertically. A surface 16 of the device is for changing the cans and, being of a known type, is not shown here as it does not concern the essence of the invention. A floor 17 or lower wall of the machine is pre-arranged with a cavity 18 therein, within which is positioned the base 19 of the raising device 20.

An upper lift plate 21 is provided and may be lined with rubber or other material suitable for increasing friction between it and the collector plate 15. The size of plate 21 is such that it can enter into the inside of the can 10 and can also bear against the undersurface of the plate 15. A fluid-type means 22 is provided for enabling a vertical raising of the plate 21. The means 22 can be activated pneumatically or hydraulically, and its lower end is fixed in a rigid manner to the fixed base 19. The fluid means 22 carries a base 23 fixed above it, which base 23 rotatably supports a surrounding cap 25 through an intermediate ball bearing unit 53.

Two pivot pins 26 are provided on the cap 25 and project radially therefrom, but there could be three or more, and in our example the pivot pins 26 are positioned diametrically opposite to one another and are solidly fixed to the cap 25. Each of the pivot pins 26 constitutes an axis of intersection for one linkage in a pantograph. The axes of intersection of each pantograph are identified by the reference numeral 27, one axis of intersection coinciding with a pivot pin 26. The rods or links of the pantograph are identified by the reference numeral 28. The axes of the end holes of the individual rods are identified by the reference numeral 29. The upper end axes 129 of the pantograph each include a pivot pin 30 slidingly received in an appropriate and substantially horizontal slot 31 formed in a support element 35 which is solidly fixed to the plate 21. A pivot pin 32 is positioned on the upper axes of intersection axes 27 and it slides within a substantially vertical slot 33 located in the support element 35.

A further support element 135 includes a vertical slot 133 within which the pivot pin 26 slides, said support element 135 being solidly fixed to the cup-shaped casing 36. The casing 36, which includes a hole 34 through which fluid means 22 projects, is rotatably supported. The casing 36 has a toothed ring gear 37 fixed thereto, which gear is activated in a known manner by a toothed gear wheel 38, which in turn is activated by drive motor 39.

Cross bars 40 are provided for connecting the lower ends of the arms 28 of one pantograph to the corresponding arms of the other pantograph. The bars 40 coordinate the opening of the pantographs and are slidably guided in horizontal slots 131 provided in the support elements 135.

Next will be considered the pneumatic activation of the devices and instances when it is desired to cause descent either through exhaust impulses which are or can be programmed or else through automation means controlled by the thrust existing on the plate 15. For this purpose, the control system illustrated in FIG. 3 includes the following: A regulating valve 41 is connected to a valve 42 which serves to govern ascent. A source of compressed air 43 is provided and is filtered by a filter 44. A pressure reducer 45 is provided adjacent the filter 44 and can be embodied in a lubrication means. A rapid exhaust valve 46 is provided for facilitating a rapid descent and it is connected to a port on the valve 42. Silencers are provided to silence the exhausting fluid. An overpressure exhaust valve 48 which is governed by the overpressure created in the fluid-type means 22 is provided. A valve 49 for facilitating a programmed descent is provided and a regulating valve 50 is provided to calibrate the effect of the operation of the valve 49. The inputs to the exhaust valve 48 and valve 49 are each connected to the same port on the valve 42 as is the input to the valve 46.

Figure 4:
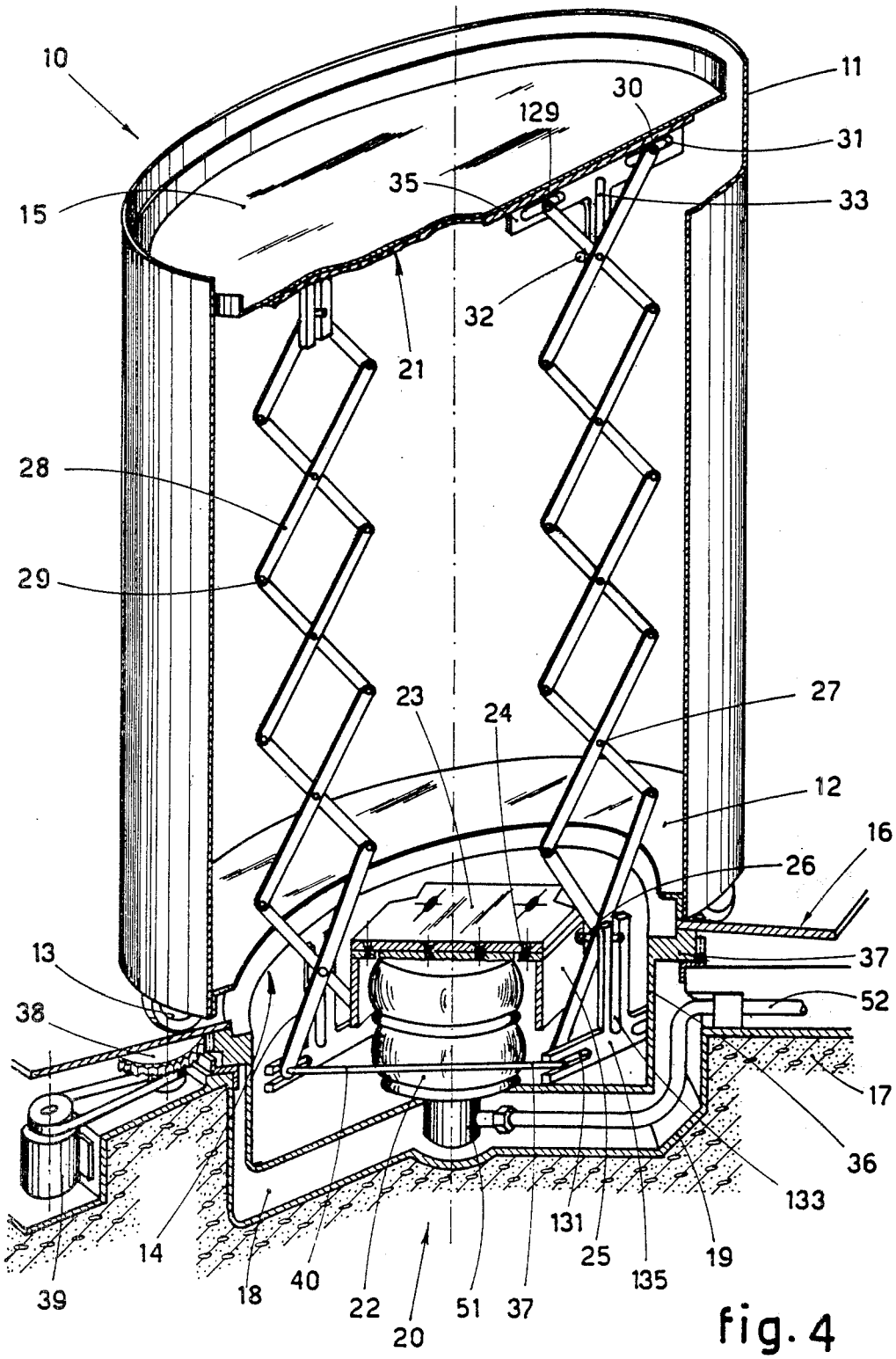
FIG. 4 shows a variation of the device of FIG. 1.
Figure 5:
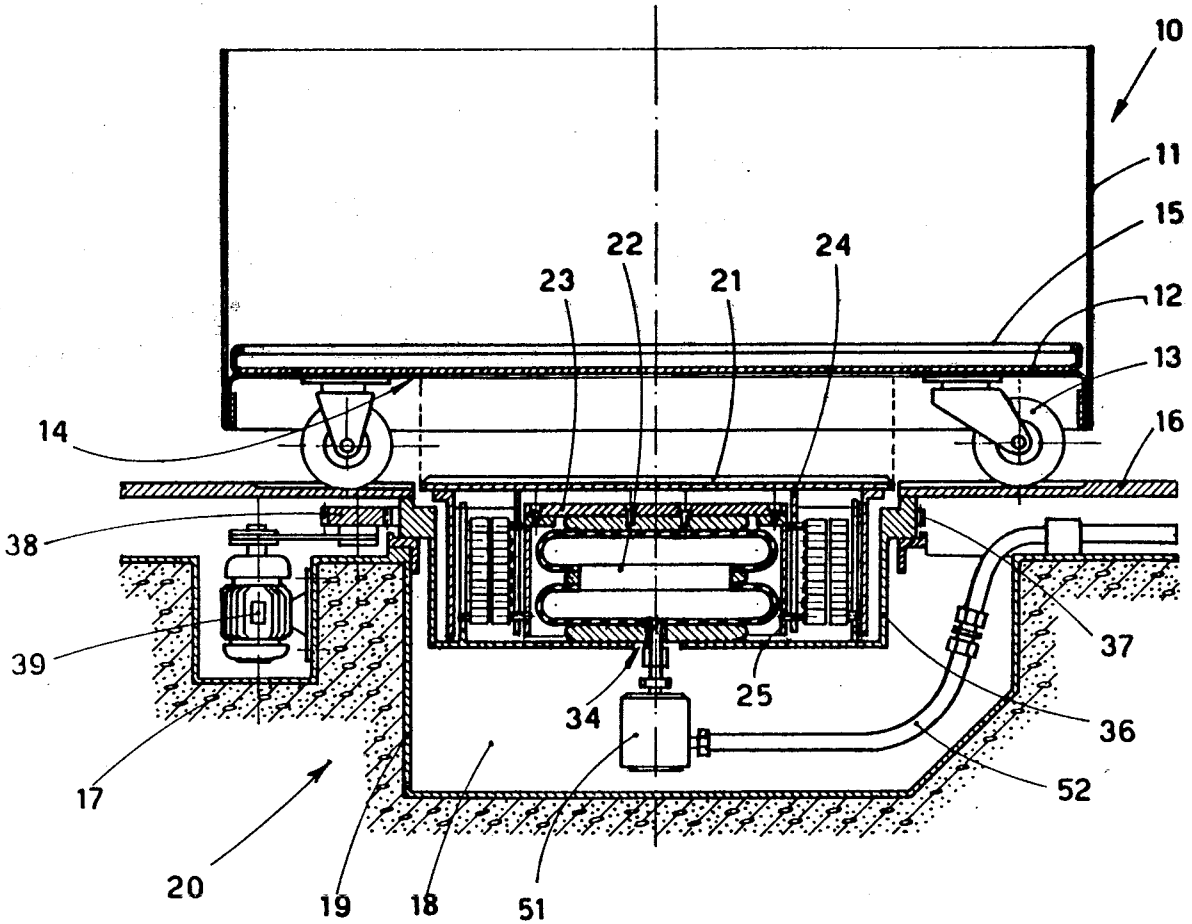
FIG. 5 is a vertical section of the device of FIG. 4.

Considering now the embodiment of FIGS. 4–5, it corresponds to the embodiment of FIGS. 1–2 except that the fluid-type means 22 in FIGS. 4–5 is rotatably supported inasmuch as it is fixedly connected to the casing 36, whereas the fluid means 22 in the FIGS. 1–2 embodiment has the lower end thereof fixedly positioned relative to the base 19. For this reason, the embodiment of FIGS. 4–5 utilizes the same reference numerals utilized in FIGS. 1 and 2 so as to designate the corresponding parts.

In FIGS. 4–5, the top plate 23 which is fixed to the upper end of the fluid means 22 is in turn fixed to the cap 25 by a pair of lugs 24. Further, the lower end of the fluid means 22 is fixedly supported on the base 19 of the cup-shaped casing 36 so that the fluid means is thus rotatable therewith. A rotating or slip-type joint 51 of conventional construction is connected to the lower end of the fluid means 22, which joint 51 is also connected to the fluid supply pipe 52 so that pressurized fluid can be supplied to the fluid means 22 even while the casing 36 and fluid means 22 is rotating.

OPERATION

When the can 10 has been positioned, the valve 42 is opened and introduces fluid under pressure into the fluid-type means 22, which therefore extends axially. In the embodiment of FIGS. 4–5, the fluid arrives through the joint 51.

As the fluid-type means 22 extends axially, the base 23 is raised and carries with it the cap 25. When the cap 25 is raised, the pivot pins 26 guided in slots 133 are also raised. The intersection axes 27 connected by the pivots are likewise raised and, as the lower ends of the pantograph are impeded by the cross bars 40 sliding at right angles to the axis of elevation of the intersection axes 27 on which the pivot pins 26 dwell, the pantograph becomes narrower and extends upwardly. When the pantograph extends, the upper plate 21 rises, comes into contact with the inner plate 15 and lifts it up to its top dead center.

The construction of the mechanism is such that, when the outer body 11 of the can 10 starts to rotate due to the rotaty movement imparted to the surface 16 by the toothed gear ring 37 which is solidly fixed thereto, the casing 36 also starts rotating as do the support elements 135 and the cap 25. In the embodiment of FIGS. 4–5, the fluid-type means 22 also starts rotating.

By rotating the cap 25 and the support elements 135, the pantographs and the plates 21 and 15 are also made to rotate. Since their speeds of rotation are the same as that of the can 10, there is no resistance between the inner plate 15 and the outer body 11 of the can 10.

If it is necessary to cause the inner plate 15 to descend quickly, it is sufficient to open the valve 46 and the rapid exhaust frees the fluid means 22 and allows it to be rapidly compressed, thereby enabling the pivots 26 to be lowered so that the inner plate 15 is rapidly lowered.

If it should be necessary for descent of plate 15 to be carried out in coordination with the formation of the stock of material in the can, a choice can be made between at least two methods.

The first method consists in sending a series of impulses coordinated with the storage of material in the can to the valve 49. The valve 49 opens for a determined time and allows the fluid to leave the fluid means 22, and the outflow of the fluid is calibrated by the valve 50.

The other method consists in setting the valve 48 in such a way that only when a determined pressure is applied to the plate 15, said pressure being applied by the material being stored, does the valve 48 operate to keep the resistance pressure constant. In other words, as long as the material being stored creates a pressure equal to or less than that desired on the inner plate 15, the valve 48 does not operate and perhaps might not operate even in the presence of momentary or localized overpressures, but when the pressure exceeds a desired value, the valve 48 acts and brings the opposing pressure back to the pre-set value.

We have described here a preferential solution, but variants are possible for a technician in this field. Thus it is possible to vary the proportions and sizes; it is possible to replace, integrate and add or remove parts; the chamber of the fluid means 22 could be replaced with a piston-type fluid pressure cylinder; it is possible to change the control circuit or arrange to raise the bottom of the can itself as well; it is possible to foresee another type of pantograph and another design for guiding and anchoring the pantograph; it is possible to envisage three or more pantographs, and so on.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for use with a container having a bottom wall which is movable relative to the sidewall of said container, comprising:

frame means;

mechanical extensible means, the lower end of which is mounted on said frame means;

a lift plate having an external dimension smaller than the cross-sectional dimension of the inside dimension of said sidewalls and first connecting means for connecting said lift plate to the upper end of said extensible means so that said lift plate is elevatable with said upper end of said extensible means;

vertically extendable fluid drive means mounted on said frame means and second connecting means for connecting said fluid drive means to said mechanical extensible means, said mechanical extensible means being extendable in response to an extension of said fluid drive means through said connecting means;

said bottom wall being positionable over said lift plate and elevated by said fluid drive means and said mechanical extensible means into engagement with said bottom wall, a continued elevating movement of said lift plate causing a movement of said bottom wall relative to said sidewall of said container; and rotatable support means for rotatably supporting at least said mechanical extensible means and said lift plate connected thereto and relative to said frame means and drive means for drivingly rotating said mechanical extensible means and said lift plate when said lift plate is in engagement with said bottom wall.

2. The device according to claim 1, wherein said frame means includes a fixed base structure which supports thereon said fluid drive means, wherein said rotatable support means includes a rotating casing having a hole therein through which extends said fluid drive means, said mechanical extensible means including pantograph means terminally anchored at said lower end in slots extending at right angles to the axis of extension thereof, said lower end of said pantograph means being fixed to said rotating casing, and said upper end thereof being fixed to said lift plate.

3. The device according to claim 1, wherein said frame means includes a rotating casing supporting thereon said fluid drive means and said lower end of said mechanical extensible means, said mechanical extensible means including pantograph means terminally anchored at said lower end in slots extending at right angles to the axis of extension thereof, said lower end of said pantograph means being solidly fixed to said rotating casing and said upper end thereof being solidly fixed to said lift plate.

4. The device according to claim 2, wherein said fluid drive means comprises a pneumatic chamber which can extend vertically and is positioned axially of said base structure.

5. The device according to claim 2 or claim 3, wherein said casing causes rotation of said lift plate due to said mechanical extensible means connected therebetween.

6. The device according to claim 2 or claim 3, wherein said mechanical extensible means includes at least two pantographs positioned at the sides of said fluid drive means and including means for coordinating the movement of both thereof.

* * * * *